US005967062A

United States Patent [19]

Larson et al.

[11] Patent Number: 5,967,062

[45] Date of Patent: Oct. 19, 1999

[54] ROTATING TIRE COMBUSTER

[75] Inventors: Jack B. Larson, Martinsville; James C. Branscome, Basset, both of Va.

[73] Assignee: Atlantic Pacific Energy Systems, Inc., Martinsville, Va.

[21] Appl. No.: 08/966,135

[22] Filed: Nov. 7, 1997

Related U.S. Application Data

[60] Provisional application No. 60/031,320, Nov. 19, 1996.

[51] Int. Cl.[6] ..... F23G 5/00

[52] U.S. Cl. ..... 110/235; 110/101 R; 110/105; 110/210; 110/226; 110/228; 110/246; 110/258; 432/105; 432/113

[58] Field of Search ..... 110/101 R, 105, 110/105.5, 108, 203, 210, 226, 227, 228, 235, 246, 258, 255, 257, 267, 229; 432/95, 103, 105, 112, 113; 414/147, 149, 150, 152, 154

[56] References Cited

U.S. PATENT DOCUMENTS

| | | | |
|---|---|---|---|
| 1,698,454 | 1/1929 | Schaaf | 110/246 X |
| 3,152,796 | 10/1964 | Ramstack, Jr. | 110/246 |
| 3,412,697 | 11/1968 | Matteini | 110/246 |
| 3,838,015 | 9/1974 | Buchbinder et al. | 110/246 X |
| 3,882,801 | 5/1975 | Bolle | 110/246 X |
| 3,916,807 | 11/1975 | Eiki | 110/246 |
| 3,946,680 | 3/1976 | Laman . | |
| 4,180,004 | 12/1979 | Johnson | 110/346 |
| 4,551,051 | 11/1985 | Hofbauer et al. . | |
| 4,565,138 | 1/1986 | Ueda et al. | 110/346 |
| 4,583,468 | 4/1986 | Reed et al. | 110/246 |
| 4,895,083 | 1/1990 | McDilda | 110/235 |
| 5,005,493 | 4/1991 | Gitman . | |
| 5,301,619 | 4/1994 | Keersmaekers | 110/246 |
| 5,495,812 | 3/1996 | Schulze | 110/257 X |
| 5,535,685 | 7/1996 | Choi | 110/229 X |
| 5,564,349 | 10/1996 | Hartington | 110/246 |

FOREIGN PATENT DOCUMENTS

| | | | |
|---|---|---|---|
| 23 43 954 | 3/1975 | Germany | 110/246 |
| 59-202314 | 11/1984 | Japan | 110/246 |

*Primary Examiner*—Ira S. Lazarus
*Assistant Examiner*—Ljiljana V. Ciric
*Attorney, Agent, or Firm*—Woods, Rogers & Hazlegrove, PLC; C. Fred Rosenbaum

[57] ABSTRACT

An apparatus burns tires in a horizontally rotating combuster. The tires are loaded into a rotating combustion chamber through a traveling air lock and burned until they are reduced to ash. Combustion is enhanced by tumbling the burning tires in the rotating chamber while adding preheated draft air. The intake draft air is controlled using thermal expansion of the rotary combustion chamber to activate the draft control valve. The inner surface of the chamber is tapered in order to prevent unburned debris from advancing prematurely; however, angled flights, positioned along the inner surface, cause the residual ash to advance with each successive revolution of the combustion chamber. The resulting combination of gases and ash are then forwarded to an afterburner for completion of the combustion and disposal of the ash.

15 Claims, 3 Drawing Sheets

ROTATING TIRE COMBUSTER

Priority is claimed for this application under 35 USC 119(e) based on Provisional Application Ser. No. 60/031,320, filed Nov. 19, 1996,

BACKGROUND OF THE INVENTION

1. Field of the Invention

The present apparatus relates to the disposal of tires through combustion. It has been shown that tire combustion is possible by using stationary incinerators. In such devices, tires are not mixed as they burn and the solid by-products of combustion are gathered in collection ducts. In contrast, the present apparatus differs from previous methods of tire combustion in that the entire combuster rotates. Tires are tumbled and retained in the primary burn zone for as long as possible. After tires have been reduced to ash, solid waste is forwarded to the exhaust area using a series of baffles, i.e. flights. Once the hot gases and solid debris have left the exhaust area, they enter the afterburner, where complete burning of the remaining volitiles is performed using a secondary enrichment of oxyzen.

2. Prior Art

The U.S. Pat. Nos. 3,946,680; 4,565,138; 4,551,051; 4,895,083; and 4,180,004 disclose various appratuses used for combustion of tires. This apparatus; however, differs from previous efforts at tire combustion in several ways.

U.S. Pat. Nos. 4,551,051 and 4,565,138, illustrate an inclined ramp and a ram, respectively, for loading tires into the primary burn zone, U.S. Pat. No. 4,180,004 teaches the step of shredding the tires before delivery to the combuster.

U.S. Pat. Nos. 4,895,083; 4,565,138; and 3,946,680, burn the tires as a resting pile.

SUMMARY OF THE INVENTION

It is the object of the invention to provide a means for disposing of tires by combustion using a rotating burn chamber.

A principle objective of this invention is to provide a means for removing the solid by-products of the tire combustion from the primary burn area by using a series of inclined baffles, resembling the threads of an internal lead screw, which carry the debris toward the exit of the combuster at a rate slow enough to allow thorough combustion.

Another important objective of this invention is to provide a method for loading the tires into the combuster using an airlock with an automated lid.

Another important objective of this invention is to provide a method for loading tires into the combuster using a sealed airlock which reduces the ingress of air and the egress of the volatile gases through the loading opening and places the tires into the combuster in a controlled manner.

Another important objective of this invention is to provide a method for burning tires based on a rotating combuster that tumbles the tires as they burn to ensure thorough and rapid combustion.

Another important objective of this invention is to provide a means of enhancing tire combustion using a preheated draft.

Another important objective of this invention is to provide a means for controlling the intake draft using the thermal expansion of the rotary combustion chamber to activate a draft control valve.

Another important objective of this invention is to provide shielded draft entry to prevent debris from backflowing into the draft air ducts.

Another important objective of this invention is to provide a means for preventing tire refuse from leaving the burn area prematurely by using a ramp in the rotary combustion chamber.

Other important objectives of this invention include preheating the draft air to promote rapid combustion in the primary burn zone and the use of a tire fueled afterburner to eliminate remaining volatiles escaping from the primary burn zone.

DESCRIPTION OF THE PREFERRED EMBODIMENT

Overview

The combustion process utilizes two main chambers; the rotary combustion chamber and the secondary combustion chamber. First, tires are loaded into the rotary combustion chamber by means of an automated airlock. Once inside, the tires or fuel is exposed to a preheated draft that provides oxygen-rich air to the primary burn zone. After the tires have been reduced to ash and hot gases, the by-products are forwarded into the secondary combustion chamber or afterburner. Within the afterburner, solid waste is removed from the airstream and remaining volatiles are eliminated using a secondary enrichment of oxygen.

Figure 1:
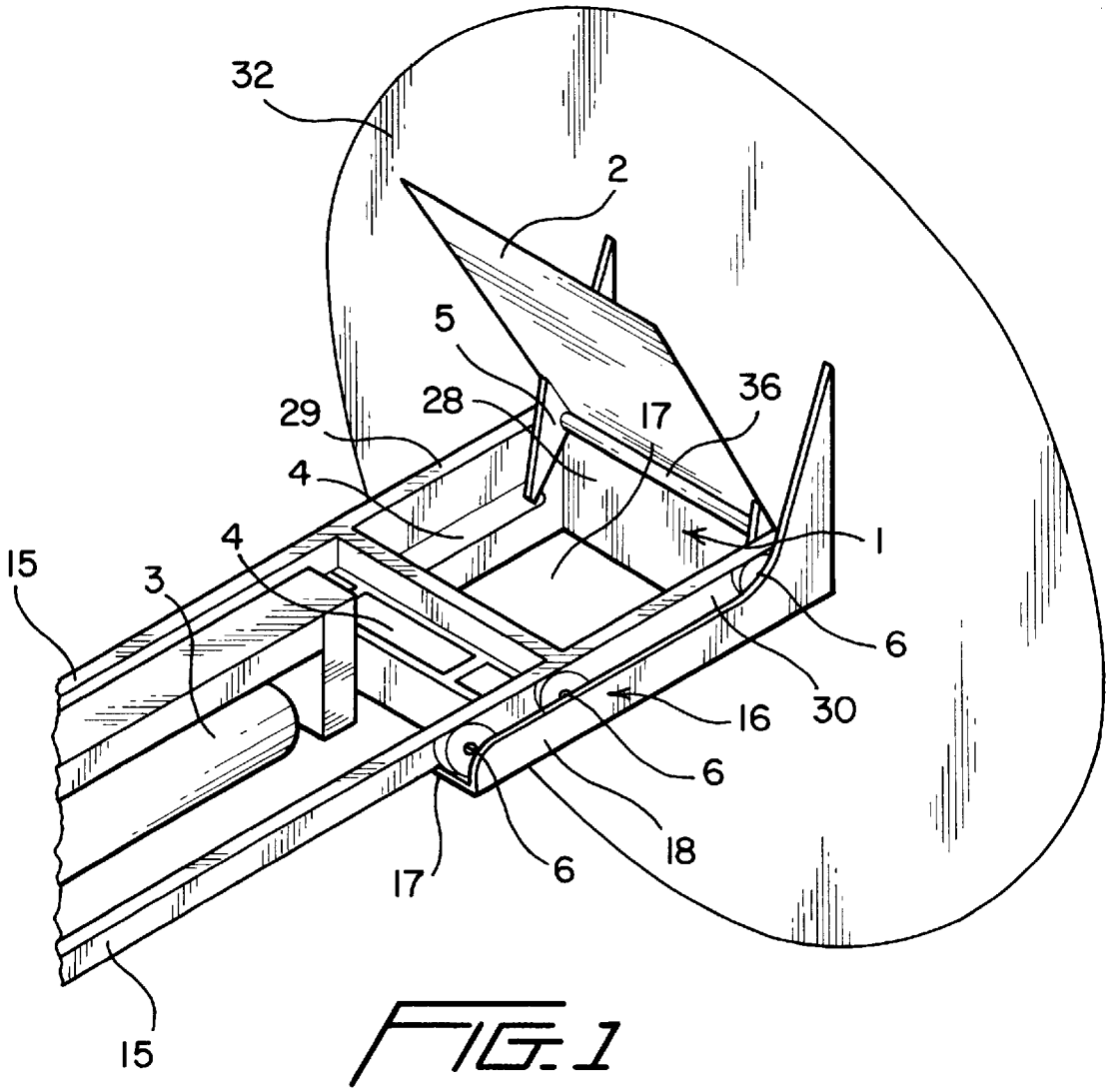
FIG. 1 is an isometric drawing of the tire injector airlock.

The tires are loaded into the rotary combustion chamber by means of a tire injecting airlock, shown in FIG. 1. A sliding carriage 1 is used to transport tires into the rotary combustion chamber one at a time. As shown in FIG. 1, the sliding carriage 1 is formed as a bottomless rectangular box with a forward wall 28, side walls 29 and 30 and a rear wall 31. As shown in FIG. 1, the forward wall 28 forms the portion of the airlock between the interior of the combustion chamber and the outside environment. FIG. 1 shows an automated lid 2 on the carriage which has been designed to open and close automatically at the appropriate time during the tire loading process. The lid 2 is connected to the sliding carriage 1 by a hinge 36 extending between the side walls 29 and 30. In order to open the lid, for example, a pneumatic cylinder 3 is employed. The cylinder applies force on a lever arm 5, mounted below the lid, by means of a mechanical assembly 4 which extends through the rear wall 31. This arrangement allows the cylinder to hold the lid open because the force acting on the lever arm 5 has enough leverage and magnitude to hold the lid in position.

The sliding carriage 1 is movably mounted in a channel shaped ramp 16. The ramp 16 is mounted on the wall 32 which closes the front end of the combustion chamber. The ramp 16 surrounds the loading aperature 33, shown in FIG. 3. The amp 16 has a planar surface 17 of which a portion, shown encompassed by the walls of the sliding carriage in FIG. 1, forms the bottom of the airlock. Wheels 6 are mounted on the upstanding sidewalls 18 of the ramp 16.

Once the tire has been loaded, the lid 2 is closed by reversing the force from the pneumatic cylinder 3. This action applies less force at the lever arm 5 and causes the lid to rotate about its hinge 36 to a closed position. Consequently, the movements of the mechanical assembly 4 operated by the pneumatic cylinder play a major role in automating the lid of the carriage.

In addition to controlling the carriage lid 2, the pneumatic cylinder 3 is also used to inject tires into the rotary combustion chamber. Once a tire has been loaded into the carriage, initial extension of the pneumatic cylinder's piston seals the tire in the carriage by automatically closing the lid 2. Further extension rolls the sealed carriage 1 across a series of wheels 6 and into the rotary combustion chamber shown in FIG. 2. Once inside, the carriage frame 1 is supported by its track 15 over a bottomless region opening directly into the primary burn zone 7. Because the sealed carriage is bottomless, the carriage will empty before the rear wall 31 is extended into the rotary burn chamber thereby maintaining the separation between the interior of the burn chamber and the outside environment, The tire drops into the rotary combustion chamber and the piston of the pneumatic cylinder 3 is subsequently reversed withdrawing the empty carriage onto the ramp 16.

Reversing the piston of the pneumatic cylinder 3 causes the carriage frame 1 to retreat in a linear manner until the motion is stopped by a cushion cylinder (not shown). After the frame 1 has been returned to its original position, further retraction of the assembly 4 by the pneumatic cylinder 3 applies enough force on the lever arm 5 to cause the lid 2 to open, ready for the next tire to be added.

Collectively, regions or zones 7, 8, and 9 comprise the rotary combustion chamber. Essentially, it is a tube of varying diameters across its longitudinal axis which may be constructed of one or several sections. The purpose of the rotary combustion chamber is to provide a means for burning tires and removing the waste generated from combustion. This is accomplished by rotating the combuster on powered rollers 10 and tumbling the burning debris across a series of inclined baffles 11 positioned along the inner wall of the rotary combustion chamber.

As the rotary combustion chamber rotates, provisions are made to support it under longitudinal and radial thermal expansion. The rotary combustion chamber is supported at positions A, B, and C by powered rollers 10. Radial thermal expansion is addressed by using bearings 12 that are sized to fit the rotary combustion chamber at the running temperature. Longitudinal thermal expansion is limited at position A such that the rotary combustion chamber can expand only towards its narrow end. The uniaxial thermal expansion is used in conjunction with mechanical duct valves 13 to control the draft balance in the rotating chamber.

The primary burn zone 7 accelerates tire combustion by tumbling the tires within the burn chamber and exposing them to oxygen-rich, preheated draft air. Heat is recovered from the combustion process by draft air passing through the draft passage 19 between the outer layer 21 and the inner layer 22 of the rotary combustion chamber wall and returned to the primary burn zone 7 at shielded draft entrances 14. The shields covering the draft entrances are aligned so as not to allow debris to backflow into the air ducts and they protrude into the burn zone far enough to help tumble the tires as the rotary combustion chamber rotates. Tumbling the tires and using preheated draft air ensures that all burnable materials undergo accelerated combustion in the primary burn zone.

The reduced tire conveyer zone 8 continuously removes solid waste from the primary burn zone 7 and prevents unburned tires from advancing prematurely in the combuster. The slope of the tube in this region of the combuster serves as a means for fuel retention; unburned tires fall backwards into the primary burn zone 7 until they are reduced to small pieces, and ash. These small pieces are then carried by flights or baffles 11, resembling the threads of an internal lead screw, toward the exhaust zone 9 at a rate slow enough to allow completion of the tire-reduction process. The flights 11 continuously lift solid material from the bottom of the combuster, then drop it so that it falls through the hot gases. Turning the material with the flights enhances combustion by ensuring good temperature uniformity. Consequently, the slope of the reduced tire conveyor zone provides maximum fuel retention, and the flights 11 along the inner wall promote continuous waste removal and uniform tire combustion.

Figure 3:
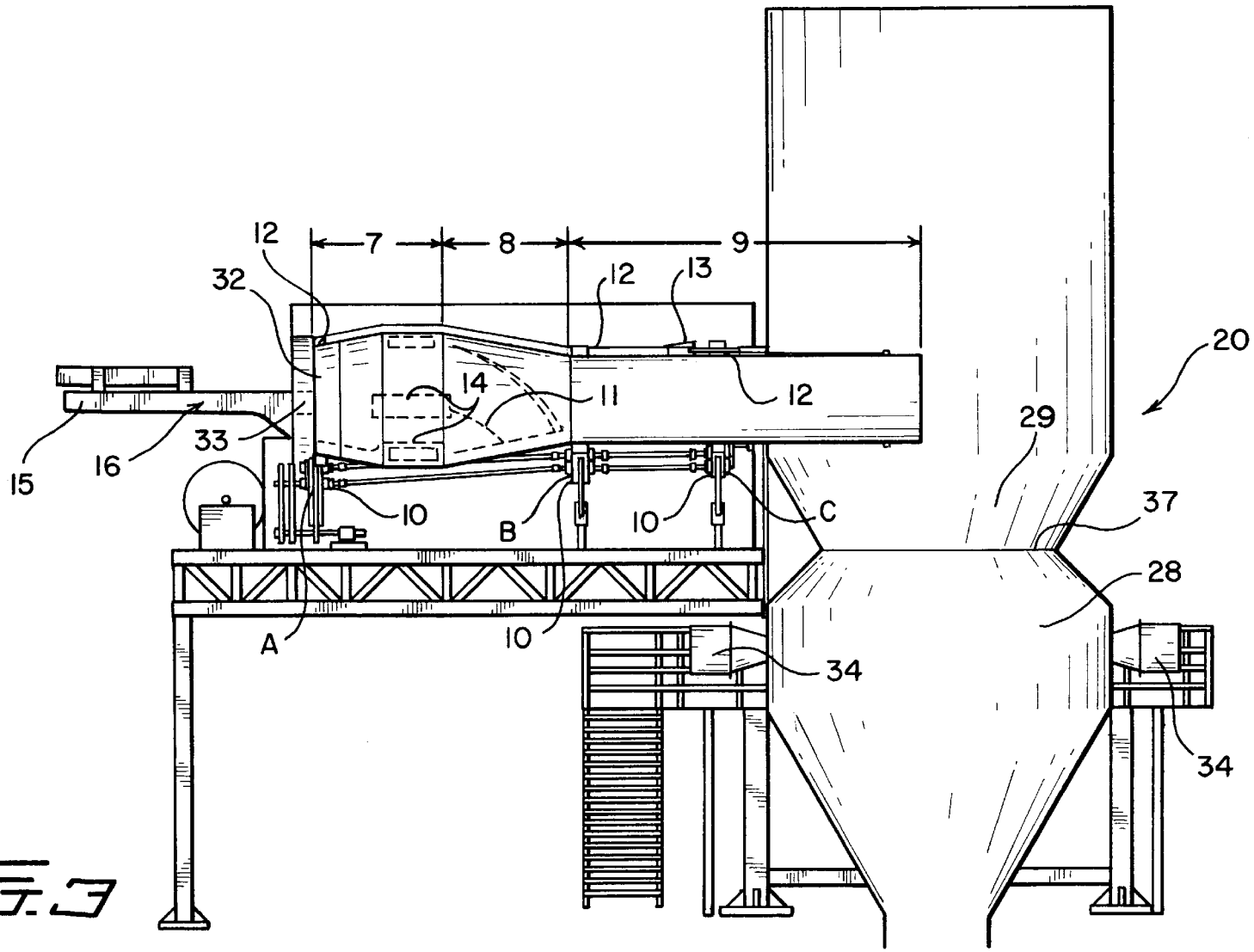
FIG. 3 is a cross sectional view of the rotary combustion chamber including the afterburner as viewed from the side.

The exhaust tube zone 9 routes the burned debris and hot gases to an afterburner 20, shown in FIG. 3, and provides a means for controlling the draft balance in the rotating chamber. The end of the tube protrudes slightly into the afterburner so that ash drops to the bottom, while hot gases continue upwards through the afterburner, to a boiler or some other device downstream.

Figure 2:
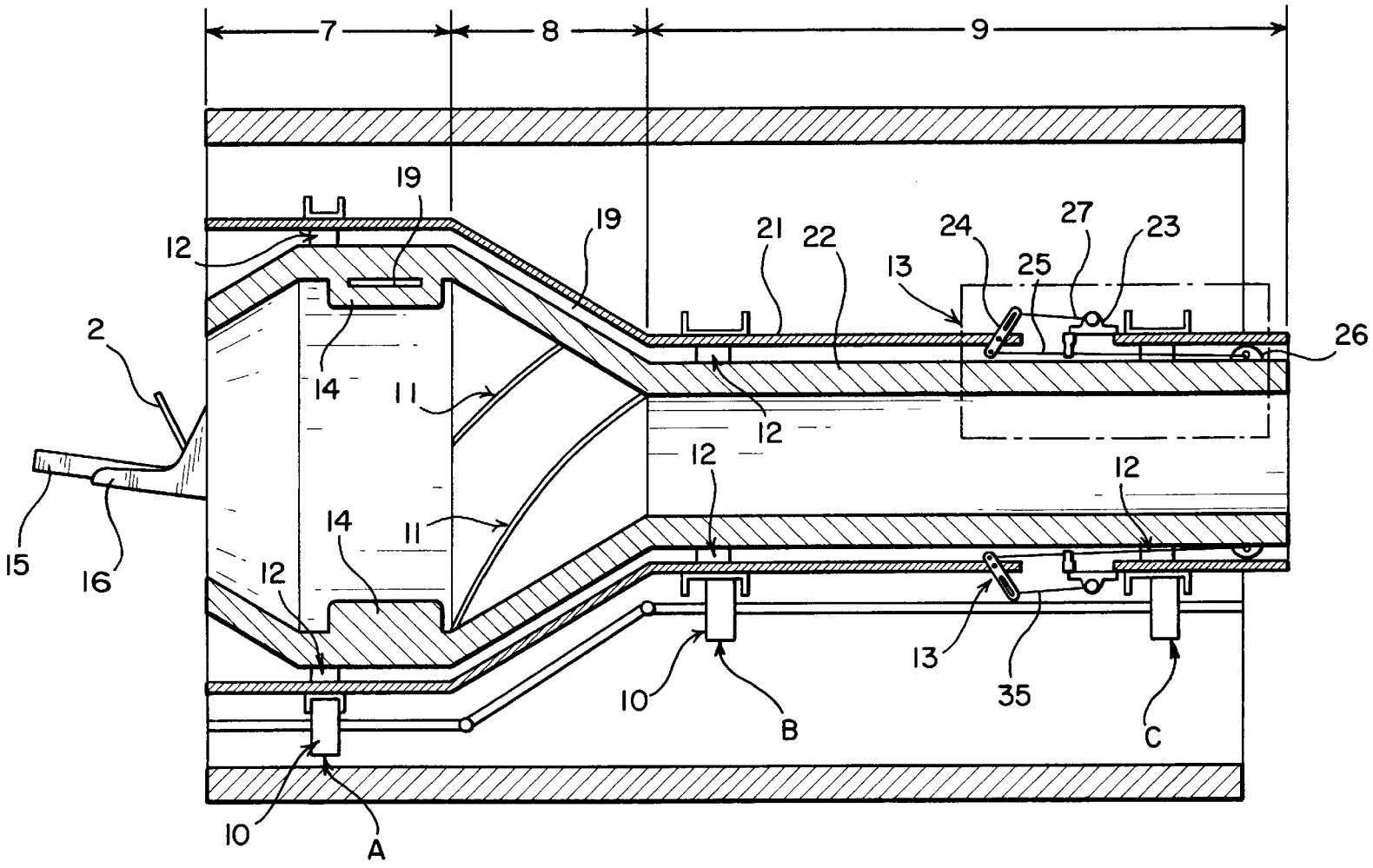
FIG. 2 is a cross sectional view of the rotary combustion chamber as viewed from the side.

Draft balance control is accomplished using the thermal expansion of the unit to activate a draft control valve or duct switch 13. The draft control valve 13 has a flap valve 23 mounted on outer layer 21 of the rotary combustion chamber. The position of the flap valve 23 is controlled by an elongated actuator 24 and biasing device 35. The actuator is pivotally mounted on outer layer 21. One end of the actuator 24 is connected to the flap valve 23 and the other end is connected at 26 to the inner layer 22 by connecting members 25. When the system is running cool, thermal cooling will cause the duct switch 13 to direct draft air straight to the primary burn zone 7, as shown in FIG. 2. Entering draft air will in turn increase combustion in the primary burn zone and return the system to higher temperatures. In contrast, when the system is running hot, longitudinal thermal expansion causes inner layer 22 to elongate moving 26 longitudinally to pivot actuator 24 opening flap valve 23 to direct oxygen-rich draft air away from the primary burn zone 7 and into the afterburner. The oxygen-rich draft air mixes with the hot gases within the afterburner, causing complete combustion of any remaining volatiles, while the ash drops to the bottom of the afterburner for removal and processing.

The purpose of the afterburner is to eliminate remaining volatiles from the reduced tires and to remove ash from the flow of hot gases. In order to enhance the secondary combustion process, the reduced tires are exposed to a secondary enrichment of oxygen in the secondary combustion chamber 27. Any remaining ash is thrown against the inner wall of the afterburner, whereupon the ash slides along the wall toward the bottom of the afterburner for collection and removal.

In order to bring the afterburner to operating temperature in a timely manner, the afterburner has been equipped with a semi-isolated preheat chamber 28 separated from the secondary combustion chamber 27 by a partition 37. Oil burners 34 within the chamber have the ability to supplement energy requirements in the absence of tire fuel. Most of the time, however; the preheat burners will not be running, as the heat energy from the tire fuel will be enough to eliminate remaining volatiles once the secondary enrichment of oxygen is applied. Once the tires have completed the combustion process, the ash is removed from the afterburner from the base of the structure after having passed through partition 37 and the hot gases are forwarded to a boiler or some other device downstream.

The rotary tire combuster provides a means to improve the combustion of passenger and highway truck tires. The intake draft is preheated, the tires are tumbled, and the apparatus is supported in ways which work cohesively to enhance the combustion process.

The supports, for example, allow longitudinal thermal expansion of the apparatus as the unit changes temperature.

As a result, changes in the length of the combuster reposition a draft control valve attached to the rotary combustion chamber. This valve, in turn, directs air toward the primary burn zone, forming a preheated draft, or towards the afterburner, providing a secondary enrichment of oxygen. In either case, oxygen rich air is automatically directed to different regions of the apparatus in order to control the temperature and to use the draft air as efficiently as possible.

Tires are loaded using an automated airlock that is designed to minimize smoke and energy losses at the entrance. Once inside the rotary combustion chamber, the tires are retained in the primary burn zone until reduced to ash and hot gases. Continual rotation of the combuster tumbles the debris across a series of internally mounted baffles that lift the ash from the bottom of the pile and advance it towards the exhaust end of the tube. Once past the exhaust, any remaining volatiles are eliminated in an afterburner using secondary enrichment of oxygen. In addition to separating the ash from the fuel, the baffles, or flights, turn the debris in order to ensure good temperature uniformity.

Consequently, the rotating combuster is an improvement in the field of tire combustion. It tumbles the burning mixture and channels draft air in ways which enhance the combustion process. Although a conveyor belt is not used in the primary burn zone, as in other combusters, its streamlined design and other qualities make it a viable apparatus for the production of tire derived fuel.

In a general manner, while there has been disclosed an effective embodiment of the invention, it should be well understood that the invention is not limited to such an embodiment as there might be changes made in the arrangement, disposition and form of the parts without departing from the principle of the invention embodied in the claims.

We claim:

1. A furnace for thermally decomposing waste materials comprising a frame and an elongated combustion chamber supported by said frame, said combustion chamber being disposed horizontally on said frame, said frame including rollers in contact with said combustion chamber for rotary movement of said combustion chamber, said combustion chamber having a large diameter primary burn zone and a smaller diameter exhaust tube zone connected through a tapered conveyer zone, said primary burn chamber having an inner wall layer and an outer wall layer, a draft passageway formed between said inner and outer layers, said passageway connected to said primary burn zone at one end, said one end having a shield structure to prevent combustion products from entering into said passageway during rotation, said draft passageway conveying air to said primary burn zone, and said combustion chamber having internal baffles adapted to advance waste materials toward said smaller diameter tube zone during rotation whereby said waste materials are agitated in said primary burn chamber until decomposed.

2. The furnace of claim 1, in which said tapered conveyor zone of said combustion chamber between said large diameter primary burn zone and said smaller diameter exhaust tube zone forms a barrier for partially decomposed waste materials whereby partially burned materials are retained in the primary burn zone.

3. The furnace of claim 2, in which said internal baffles are disposed on said inner wall layer in the said tapered conveyer zone in the form of a helix to advance decomposed waste materials toward said smaller diameter exhaust tube zone during rotation of said combustion chamber, said baffles sized to provide support for small particles of waste materials.

4. The furnace of claim 1, in which said frame comprises flexible external braces supporting said combustion chamber under thermal expansion, said large diameter primary burn zone fixed in said frame to permit thermal expansion along the longitudinal axis in the direction of said smaller diameter exhaust tube zone.

5. The furnace of claim 1, in which said draft passageway has at least one opening for balancing draft air, a draft control valve means located on said at least one opening for controlling draft air balance, said draft control valve means activated by variances in longitudinal thermal expansion between said inner wall layer and said outer wall layer of said combustion chamber.

6. The furnace of claim 5, in which said opening is located in said outer wall layer, said draft control valve means for controlling draft air balance comprises a valve flap movably mounted on said outer wall layer to open and close said opening, said valve flap biased to close said opening, an actuator connected between said flap valve and said inner wall layer, said actuator opening said valve in response to movement of said inner wall layer in relation to said outer wall layer.

7. The furnace of claim 6 wherein said outer wall layer has a plurality of said openings, each of said openings having a draft control valve means for controlling draft air balance.

8. The furnace of claim 5, wherein said draft control valve means balances draft air between said primary burn zone and said afterburner, depending upon the thermal expansion of said inner wall layer.

9. The furnace of claim 5 wherein said combustion chamber includes a wall supported by said frame, said wall closing one end of said primary burn zone, said wall having a loading aperture therethrough, said wall having an airlock means opposite said primary burn zone for loading waste materials into said primary burn zone without exposing said primary burn zone to the environment, said airlock means composed of a ramp affixed to said wall adjacent said aperture and a movable carriage carried by said ramp, said carriage having upstanding walls for containing said waste materials and a closable top connected to said walls, said closed carriage movable along said ramp into said primary burn zone and returning to said ramp.

10. The furnace of claim 1, including an afterburner operatively connected to said smaller diameter exhaust tube zone of said combustion chamber, said afterburner providing a secondary combustion chamber employed to eliminate remaining volatiles.

11. The furnace of claim 10, in which said afterburner includes a semi-isolated preheat chamber.

12. A furnace for thermally decomposing waste materials having a combustion chamber, said combustion chamber having an end wall, said end wall having an outside surface, said wall having an inner surface within said combustion chamber, said end wall containing an aperture, a channel-shaped ramp connected to said outside surface of said end wall about said aperture, said channel-shaped ramp having a planar bottom and vertical sides, said channel-shaped ramp having wheels mounted on said vertical sides, an airlock means for minimizing escape of gases from said combustion chamber comprising movable carriage mounted in said channel-shaped ramp, said carriage having an integral forward wall, spaced apart parallel side walls and a back wall, said carriage having a top secured to said side walls through a hinge, an integral track extending from the said rear wall cooperating with said wheels for movement of said carriage along said channel-shaped ramp to extend said carriage through said aperture into and retract said carriage from said combustion chamber, said carriage substantially filling said aperture at all times.

13. A furnace of claim 12 wherein said airlock means has a power means for operating said carriage automatically, said top having an integral linkage to said power means whereby the top is closed upon initial movement of said power means and continued movement of said power means moves said carriage into said combustion chamber and upon reversal of movement of said power means said carriage is withdrawn from said combustion chamber a certain distance with continued movement of said power means translated through said linkage to open said top.

14. A furnace for thermally decomposing waste materials comprising a primary burn chamber, said primary burn chamber having an inner wall layer and an outer wall layer spaced apart therefrom, said space forming a draft passageway for introduction of air into said primary burn chamber, one end of said draft passageway opening into said primary burn chamber, the other end of said draft passageway having at least one draft control valve means for varying the amount of air in said space, said draft control valve means having an actuator connected to said inner wall layer and said outer wall layer, said actuator operating said draft control valve means by variances in longitudinal thermal expansion between said inner wall layer and said outer wall layer.

15. The furnace of claim 14 wherein said primary burn zone is closed at one end by a wall formed with an aperture therethrough, said wall having an inner surface exposed to the primary burn zone and an outer surface exposed to the environment, said outer surface carrying an airlock means for loading waste materials into said primary burn zone, said airlock means comprising a ramp supporting a movable carriage, said ramp and said carriage cooperating to form an airlock whereby said carriage traverses said aperture in said wall without opening said primary burn zone to the environment.

* * * * *